United States Patent [19]

Jungkind

[11] Patent Number: 4,722,613

[45] Date of Patent: Feb. 2, 1988

[54] CROSS-COUNTRY SKI BINDING

[75] Inventor: Roland Jungkind, Garmisch-Partenkirchen, Fed. Rep. of Germany

[73] Assignee: Metallwerk K. Pittl Ges. mbH & Co. KG, Austria

[21] Appl. No.: 898,912

[22] Filed: Aug. 21, 1986

[30] Foreign Application Priority Data

Aug. 22, 1985 [DE] Fed. Rep. of Germany ..... 3530095

[51] Int. Cl.[4] ..... A63C 9/086

[52] U.S. Cl. ..... 280/615; 280/626; 280/632; 280/634

[58] Field of Search ..... 280/614, 615, 623, 626, 280/628, 631, 632, 634

[56] References Cited

U.S. PATENT DOCUMENTS 4,146,247 3/1979 Johansson et al. ..... 280/615

*Primary Examiner*—John J. Love

*Assistant Examiner*—Richard Camby

[57] ABSTRACT

A cross-country ski binding for cross-country ski shoes which have, at their front sole end, engagement elements which correspond with and engage into engagement elements of the ski binding, to provide a pivot connection. The ski binding has a U-shaped clip or stirrup member for securing the front sole end against lifting off the ski binding engagement elements, the legs of which clip are mounted pivotably about a transverse axis by their free ends to side jaws of the ski binding, which are fixed to the ski, and which clip is loaded by a spring in the direction toward a position engaging over the front sole end by its web portion. Further, the ski binding has a spring-loaded locking lever, which can engage behind a catch projection of the ski binding by means of a latch and can thereby hold the U-shaped clip in an open position. In this open position of the clip a cam element is provided in the path of movement of the front sole end when it is inserted into the ski binding, which cam element can be actuated by the sole end so as to lift out the latch of the locking lever and to cause the clip to engage over the front sole end.

9 Claims, 5 Drawing Figures

Fig. 1
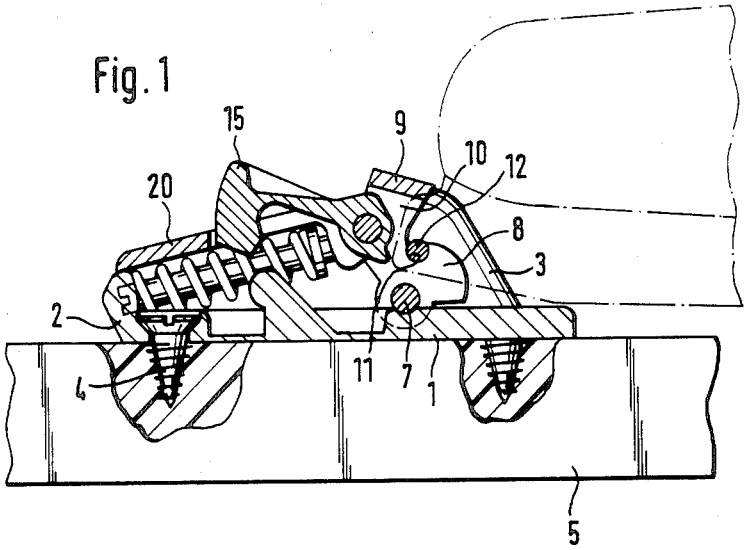
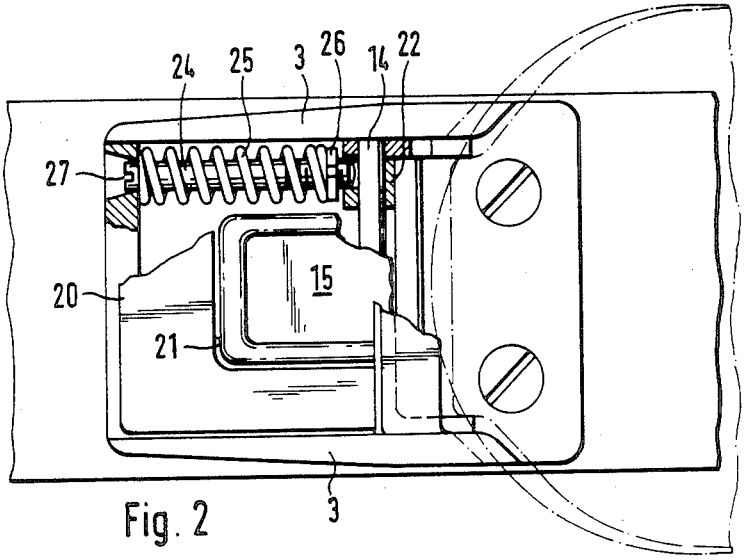
Fig. 2

CROSS-COUNTRY SKI BINDING

BACKGROUND OF THE INVENTION

In my older PCT patent application WO 85/03643 corresponding to U.S. Pat. No. 796.018 published Aug. 29, 1985, there is disclosed a cross-country ski binding for cross-country ski boots which have, at their front sole end, engagement elements which correspond with and can be inserted into engagement elements of the ski binding to produce a pivot connection. The ski binding has a U-shaped clip for securing the front sole end against lifting off the ski-binding engagement elements, the legs of which clip are mounted pivotably about a transverse axis by their free ends to side jaws of the ski binding, which are fixed to the ski, and which clip is loaded by a spring in the direction toward a position engaging over the front sole end by its web portion, and further has a spring-loaded locking lever, which can engage behind a catch projection of the ski binding by means of a latch and can thereby hold the U-shaped clip in an open position.

In the case of this cross-country ski binding according to the patent application mentioned above, the U-shaped clip can be hooked in at will on the baseplate of this ski binding by means of the locking lever, enabling the ski binding to assume a fixed open position. This facilitates introduction of the ski boot into the ski binding. The clip is brought into its position engaging over the front sole end, and thus fixing the ski boot in the ski binding, by the ski boot being raised in the manner of a walking movement after its introduction, until the upper side of the front sole end comes into contact with the web portion of the clip, after which further swinging of the ski boot takes the clip with it and causes the hooking of the locking lever on the baseplate to be automatically released. The cross-country ski binding is thus in its ready -for-use state.

SUMMARY OF THE INVENTION

The object of the present invention is an improvement of this cross-country ski binding to the extent that it is designed as a step-in binding, i.e. the ready-for-use state of the ski binding is already brought about by the action of inserting the ski boot into the ski binding and not only by the subsequent raising of the Ski boot in the manner of a walking movement.

This is achieved according to the invention by the fact that, in the open position of the clip, a cam element is provided in the path of movement of the front sole end when it is inserted into the ski binding, which cam element can be actuated by the sole end and, when actuated, lifts out the latch of the locking lever.

As in the case of the ski binding discussed above, the locking lever can be brought into engagement with the catch projection in the manner of a fixing of the open position, by the locking lever being pressed downward when the ski boot is raised, for example by the ski pole, and the ski boot subsequently being lowered. This causes the latch of the locking lever to engage behind the catch projection in the course of a backward movement and prevents a moving back of the clip, so that the latter remains in the open position and the ski boot can be lifted out of the ski binding. If the ski boot is inserted in this open position of the ski binding, the front sole end presses onto the cam element which, in this state, is in the path of movement of the sole end and which, in turn, mechanically acts on the locking lever, i.e. lifts the latter out of engagement with the catch projection. This causes the spring acting on the clip to become effective and moves the clip into the position engaging over the front sole end.

According to an advantageous embodiment, the locking lever is mounted pivotably about the clip and is acted on by a leg spring in the direction toward a disengagement position. This makes possible, in further development of the invention, the arrangement of the cam element directly on the locking lever, and expediently as an integral part thereof. The locking lever may, however, also be rigidly fixed on the clip and designed resiliently like a leaf spring. In this case, the cam element is mounted separately on the ski binding and, when activated, presses the latch of the locking lever, as described, out of engagement with the catch projection, so that the locking lever moves under its inherent resilience in the direction toward the disengagement position.

According to a further advantageous embodiment, ski-boot engagement elements provided on the front sole end take the form of laterally projecting pins which can be inserted into upwardly open bearing recesses in the legs of the clip. This design has the advantage over the hook design of the front sole end, which is likewise possible in principle and described in the patent application discussed above, that the engagement with the ski-binding engagement elements is less susceptible to malfunctions caused by soiling.

Further advantages and features of the present invention emerge from the following description of an exemplary embodiment with reference to the enclosed drawings and from further subclaims.

BRIEF DESCRIPTION OF THE DRAWINGS

FIG. 1 shows a longitudinal section through the ski binding in the ready-for-use state with inserted ski boot;

FIG. 2 shows a plan view, partially broken open, of the ski binding according to FIG. 1;

FIG. 3 shows a longitudinal section, analogous to FIG. 1, through the ski binding in the open position ready for stepping in;

DESCRIPTION OF THE PREFERRED EMBODIMENT

Figure 3:
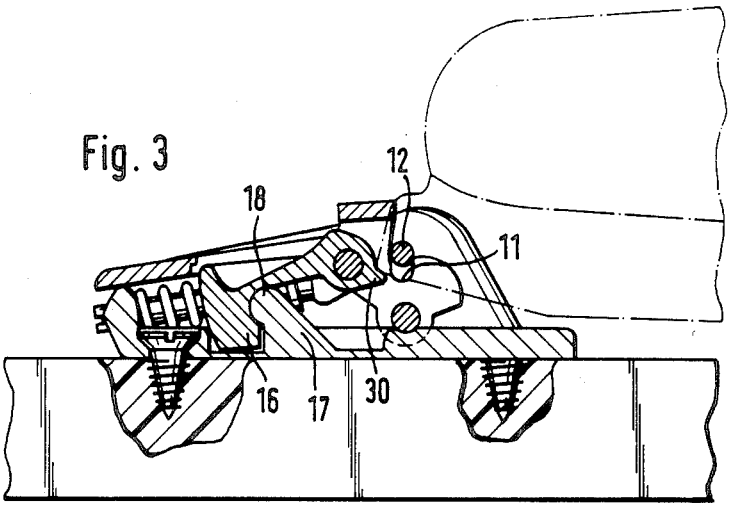

The cross-country ski binding shown comprises a baseplate 1 with a cross web 2 integrally arranged at its front end and side jaws 3. The baseplate is fixed by means of screws 4 on a ski 5.

Between the side jaws 3 extends a transverse member 7, on which a U-shaped clip 8 is pivotably mounted in the end region of its free legs. The U-shaped clip 8 has a web portion 9 which, in the ready-for-use state of the ski binding according to FIG. 1, engages in a way described in more detail below over the front sole end of a ski boot, shown in dot-dash lines, inserted into the ski binding. The legs 10 of the clip 8 have in their edges upwardly open bearing recesses 11, which serve to receive laterally projecting circular-cylindrical pins 12 of the front sole end.

Pivotably mounted on a transverse member 14 in the vicinity of the front edge of the legs 10 of the clip 8 is a locking lever 15 which bears a latch 16 at its front end (FIG. 3). Projecting upward from the baseplate 1 is a catch projection 17, which has at its top end a slightly forward protruding bulge 18. The locking lever 15 is acted on by a light torsion spring, not shown, in the direction toward the disengagement position drawn in FIG. 1.

Also pivotably mounted on the transverse member 14 is a platelike slider 20, which has a recess 21 for the locking lever 15. In the region of its front border, the slider 20 rests on the cross web 2 and has, in the region of its rear border, by which it is mounted on the transverse member 14, a thickening 22 which bears an internal thread. Screwed into this internal thread is a guide pin 24 for a helical compression spring 25, which has at a certain distance from its rear end a collar 26 as support for the helical compression spring 25. The helical compression spring 25 is supported by its front end against the inside of the cross web 2. At the front end, the guide pin 24 has a screw slit 27, so that it can be screwed more or less far into the nut-like thickening 22 by means of a screwdriver and the bias force of the helical compression spring 25 can be altered thereby. The compression spring 25 has the effect of pivoting the U-shaped clip 8 clockwise into the ready-for-use position, so that when the ski boot is inserted the web portion 9 is pressed firmly onto the upper side of the front sole end. The cross web 2 has a bore, through which the guide pin 24 can pass.

Figure 4:
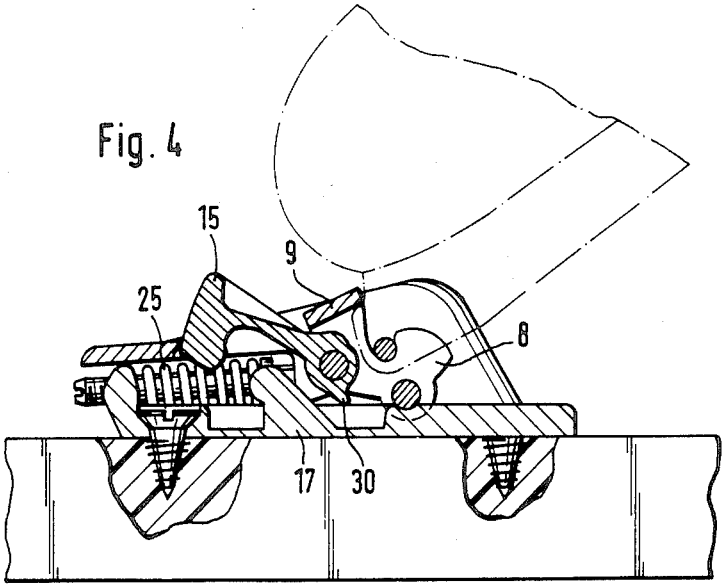
FIG. 4 shows a longitudinal section through the ski binding in the ready-for-use state with ski boot raised from the ski surface.

In the thickened region of the locking lever 15, in which the transverse member 14 passes through the latter, the locking lever 15 bears a backwardly protruding cam element 30, which in the open position of the ski binding shown in FIG. 3, protrudes into the path of movement of the front sole end when said sole end is inserted by the laterally protruding pins 12 into the bearing recesses 11. In the open position of the ski binding shown in FIG. 3, the U-shaped clip is held in its open position by the locking lever 15. In this position, the locking lever 15 engages behind the catch projection 17 by the latch 16, the bulge 18 resting in a corresponding recess of the latch 16. In this state, the force of the spring 25 is absorbed by the catch projection 17. In this open position, the front sole end of the ski boot can be inserted, by the pin 12, from above and behind into the bearing recesses 11, the rear edge of the clip legs 10, which lead toward the bearing recesses 11, serving as a guide surface. As soon as the pins 12 sink into the bearing recesses 11, the front sole end presses onto the cam element 30, so that the locking lever 15 is thereby loaded clockwise and the latch 16 is lifted out of engagement with the catch projection 17. This causes the clip 8 to again be under the force of the helical compression spring 25, which pivots the clip clockwise and backwards into the position which can be seen in FIG. 1. In this position, the web portion 9 of the clip 8 engages over the upper face of the front sole end, so that it is not possible to lift the ski boot out of the ski binding. If the ski boot is then raised in a walking movement (cf. FIG. 4), this results in a pivoting of the clip 8 against the force of the spring 25, by which a constant contact of the web portion 9 with the upper side of the front sole end is ensured. The locking lever 15 is held in the upwardly pivoted disengagement position by the torsion spring mentioned above but not shown, so that it always remains out of engagement with the catch projection 17 during the forward and backward movement of the clip 8. If the ski boot is to be released again from this ski binding, the locking lever 15 must be pressed down against the slight force of the torsion spring, for example by means of the ski stick, while the ski boot is in the raised position according to FIG. 4 and thus the latch 16 of the locking lever 15 is in front of the catch projection 17. If the ski boot is then lowered, the latch 16 comes into engagement with the catch projection 17 and blocks the clip 8 in the open position according to FIG. 3. In this open position, the pins 12 can be lifted up again out of the bearing recesses 11.

As can be seen in the drawings, the slider 20 rests on the forwardly downward sloping borders of the side jaws 3 and slides on these and on the upper edge of the cross strip 2 in the up and down movement of the ski boot during use. The slider serves for protecting the inside space enclosed by the side jaws 3 and the cross web 2 against the intrusion of snow.

Figure 5:
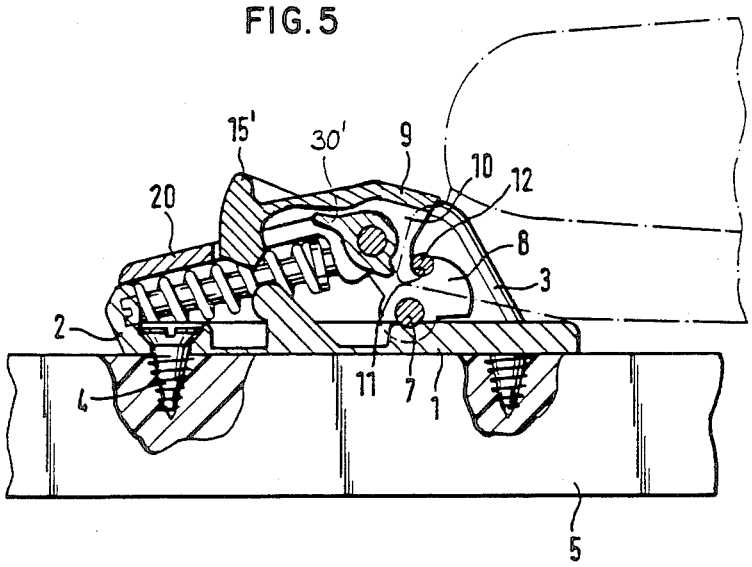

FIG. 5 shows a modification of the ski binding according to FIG. 1 wherein the same members have like reference numerals. However, in this embodiment the locking lever 15' is rigidly fixed on clip member 8 so as to be an integral portion thereof and is bendable like a leaf spring. The cam element 30' is mounted separately from the locking lever 15' on the ski binding and acts on the underside of the locking lever. In all other respects the ski binding of FIG. 5 functions similarly as described above in connection with FIGS. 1 to 4.

The invention is not restricted to the exemplary embodiment described above. For example, the locking lever 15 may also be directly mounted on the slider 20, instead of the clip 8 or the transverse member 14, and, instead of only one helical compression spring 25, two or more may be used, which press on corresponding thickenings of the slider or else directly on the cross member 14 or the clip 8. When there are used several compression springs 25, they may also have different spring characteristics and be used interchangeably in the housing formed by the cross web 2 and the side jaws 3. In this case, an adjustment capability for the compression springs, of the kind provided in the exemplary embodiment shown by the guide pin 24, may be dispensed with because the spring force is determinable by the choice of a corresponding number and/or correspondingly stiff compression springs.

I claim:

1. A cross country ski binding for cross country ski boots having a forwardly extending front sole end portion and engagement elements on said end portion, comprising a base plate mountable on a ski, a pair of side jaws extending upwardly from said base plate on opposite sides thereof, pivot means on said side jaws providing a first transverse pivot axis extending substantially parallel to said base plate, a U-shaped clip member having a web portion extending between said side jaws in parallel with respect to said transverse axis and having a pair of leg portions each projecting from a respective end of said web portion, said leg portions each having a free end by means of which said clip member is mounted pivotably on said pivot means about said first transverse axis between an open position and a clamping position, engagement means for cooperation with said engagement elements on said front sole end portion thereby to form a pivot connection between said engagement means and said engagement elements about a second transverse axis when said engagement elements are inserted into said engagement means, spring means for urging said clip member into said clamping position wherein said front sole end portion, when engaged with said engagement means by said engagement elements, is clamped between said web portion and said engagement means, a locking lever moveable with said clip member and having a lock catch and a holding spring urging the locking lever into an unlocking position, a catch portion cooperating with said lock catch and being engaged thereby in a locking position of said locking lever so as to hold said clip member in said open position, a cam element positioned in a path of movement of said front sole end portion when inserting said engagement elements into said engagement means and cooperating with said locking lever so as to disengage said lock catch of said locking lever from said catch portion.

2. Ski binding as claimed in claim 1, wherein said locking lever is mounted pivotably on said U-shaped clip member and is acted on by a leg spring in a direction towards said unlocking position.

3. Ski binding as claimed in claim 2, wherein said cam element is integral with said locking lever.

4. Ski binding as claimed in claim 1, wherein said locking lever is fixed rigidly on said clip member and is resiliently bendable.

5. Ski binding as claimed in claim 1, wherein said engagement means are integral with said clip member.

6. Ski binding as claimed in claim 5, wherein said engagement means are formed as upwardly open bearing recesses in said legs of said clip member and wherein said engagement elements are pins laterally projecting from said front sole end portion and engageable with said bearing recesses.

7. Ski binding as claimed in any of the claims 1, 5 or 6, wherein said spring means urging said clip member into said clamping position comprise a compression spring extending in the longitudinal direction of the ski and supported by a front end thereof on a cross web of the ski binding.

8. Ski binding as claimed in claim 7, wherein said compression spring is supported by a rear end thereof on a collar of a guide pin pivotably connected to said clip member.

9. Ski binding as claimed in claim 8, wherein said guide pin is formed at a rear end thereof as a screw and is adjustable in a nut pivotably mounted on said clip member.

* * * * *

UNITED STATES PATENT AND TRADEMARK OFFICE

CERTIFICATE OF CORRECTION

PATENT NO. : 4,722,613

DATED : February 2, 1988

INVENTOR(S) : Roland Jungkind

It is certified that error appears in the above–identified patent and that said Letters Patent are hereby corrected as shown below:

Title Page, Item [73] should read as follows:
--[73] Assignee: Metallwerk K. Pittl Ges.mbH & Co. KG, Fulpmes, Austria, and adidas Sportschuhfabriken Adi Dassler Stiftung & Co. KG, Herzogenaurach, Fed. Rep. of Germany

Signed and Sealed this

Thirty-first Day of January, 1989

*Attest:*

DONALD J. QUIGG

*Attesting Officer*

*Commissioner of Patents and Trademarks*